United States Patent [19]

Miller

[11] 3,981,402

[45] Sept. 21, 1976

[54] PELLET DISPENSER

[75] Inventor: Neil W. Miller, New Britain, Pa.

[73] Assignee: Merck & Co., Inc., Rahway, N.J.

[22] Filed: Feb. 26, 1974

[21] Appl. No.: 446,065

[52] U.S. Cl. ..... 206/534.2; 150/.5; 221/307

[51] Int. Cl.[2] ..... B65D 3/04; A47F 11/16

[58] Field of Search ..... 206/534.2, 528, 443, 206/445, 446; 221/307; 138/110

[56] References Cited

UNITED STATES PATENTS

| | | | |
|---|---|---|---|
| 1,435,311 | 11/1922 | Knight | 138/110 |
| 2,781,552 | 2/1957 | Gray | 206/819 X |
| 3,117,371 | 1/1964 | Farley | 138/110 X |
| 3,237,796 | 3/1966 | Callahan | 206/443 X |
| 3,292,539 | 12/1966 | Behr et al. | 206/819 X |
| 3,321,924 | 5/1967 | Liddell | 138/110 X |
| 3,471,058 | 10/1969 | Latham et al. | 150/.5 UX |
| 3,510,050 | 5/1970 | Culley et al. | 229/51 BP |

*Primary Examiner*—Leonard Summer
*Attorney, Agent, or Firm*—Donald J. Perrella; William J. Brunet; Harry E. Westlake, Jr.

[57] ABSTRACT

A dispensing container for pellets such as capsules and pills and comprising an elongated tubular member holding the pellets in a line, the member being slit helically along its length and being resilient so that when twisted about its longitudinal axis the slit opens for dispensing a pellet.

7 Claims, 11 Drawing Figures

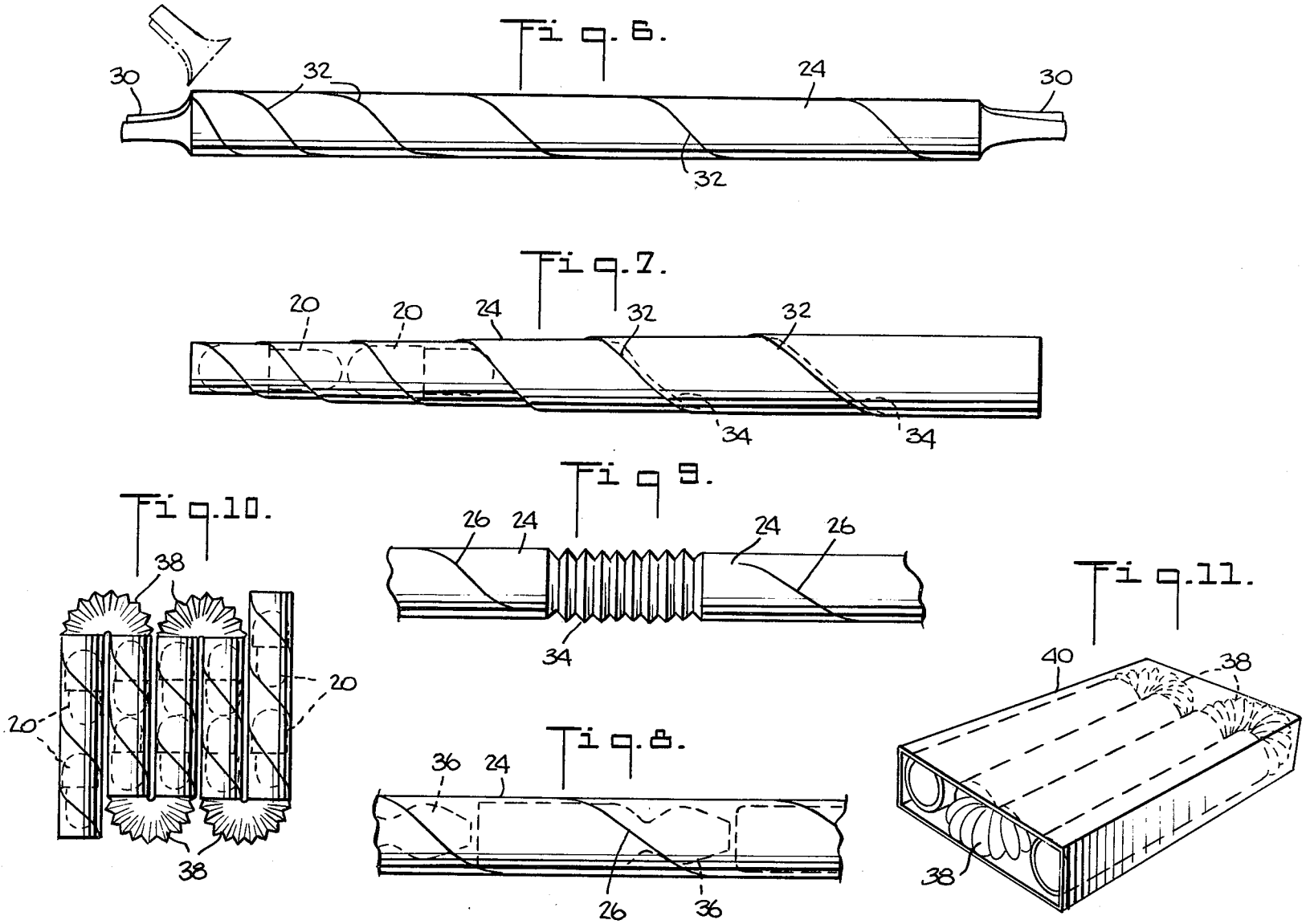
2 of 2

PELLET DISPENSER

This invention relates to containers and more particularly it concerns novel dispenser type containers for holding pellet-like elements such as pills, capsules ampules and the like.

The present invention is particularly useful in the pharmaceutical field and in the food industry where pellet-like elements, such as pills or candies are to be packaged in a dispensing type container which is capable of holding the elements in a sanitary manner. It is also desirable in many instances to hold the elements so that they only minimally touch each other, so as to avoid abrasion, transfer of substances or sticking together. Finally, it is desired to provide an inexpensive package which allows selective dispensing of any of the several elements without first having to dispense one or more of the other elements.

The present invention makes possible all of these features in a single, inexpensively produced package. According to the present invention there is provided an elongated tubular member of a stiff but resilient material, such as plastic. This member is provided with a helical slit along its length; however the stiffness of the material is sufficient to retain its tubular shape in spite of this slit. Pellet-like elements are loaded into the tubular member in aligned array along its length. In the preferred embodiments the elements are maintained firmly in position by the squeezing action of the resilient tubular member. In other embodiments the ends of the tubular member are crimped, sealed or capped to retain the elements. In both cases the elements may be dispensed simply by twisting the tubular member in opposition to the twist of its helix at any location along its length. This causes the tube to uncoil in the region of the twist so that the helical slit opens in that region for dispensing of one or more of the elements. The tube material has sufficient resiliency to cause it to return to its original closed tubular configuration after the twisting forces have been removed.

In other variations, to be described more fully hereinafter, there are provided circumferentially corrugated regions along the tubular member to allow it to be bent back and forth on itself for storage in a more compact manner.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis of the designing of other structures for carrying out the purposes of this invention. It is important, therefore, that this disclosure be regarded as including such equivalent constructions as do not depart from the spirit and scope of the invention.

Various embodiments of the invention have been chosen for purposes of illustration and description, and are shown in the accompanying drawings forming a part of the specification, wherein:

FIG. 6 is a side elevational view of a pellet dispensing container forming a further embodiment of the present invention;

FIG. 7 is an enlarged perspective view of another pellet dispensing container showing an arrangement of one form of pellets therein;

FIG. 8 is a fragmentary view of the container of FIG. 7 showing an arrangement of another form of pellets therein;

FIG. 9 is a fragmentary view of another modified construction;

FIG. 10 is a plan view of a pellet dispensing container incorporating the modified construction of FIG. 9; and FIG. 11 is perspective view of the pellet dispensing arrangement of FIG. 10 in a novel compact arrangement according to the present invention.

Figure 1:
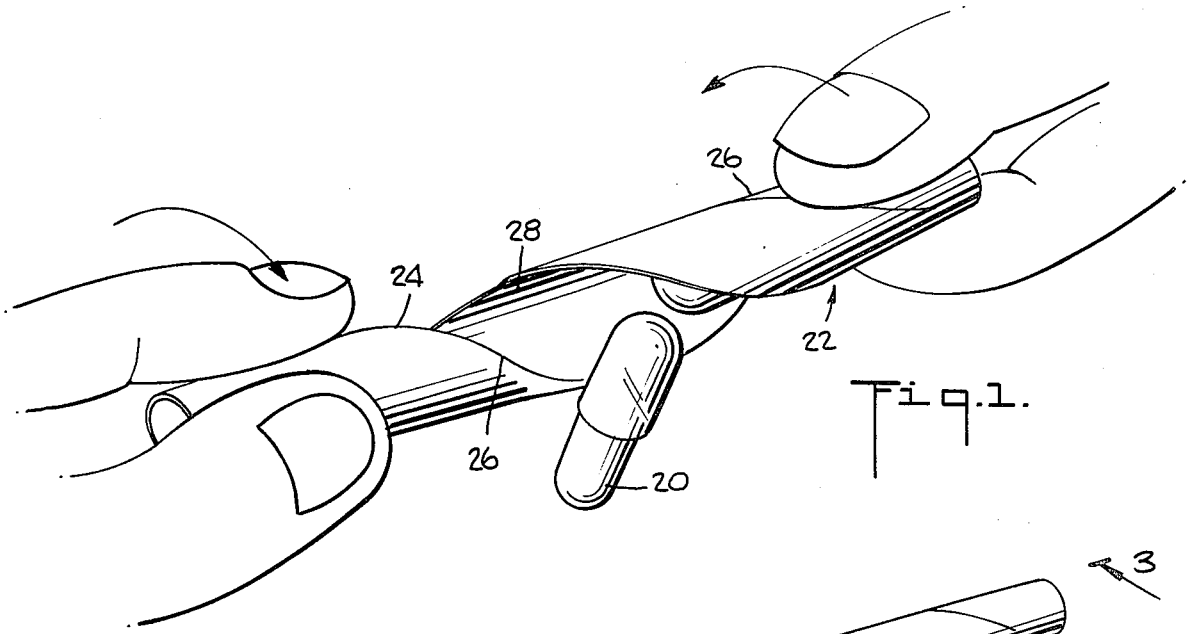
FIG. 1 is a perspective view of a pellet dispensing container according to the present invention with the container being opened for the dispensing of a pellet.

As shown in FIG. 1 a pellet 20 is released from a dispensing device 22 according to the present invention by grasping it between the thumb and forefinger of each hand and twisting it longitudinally.

Figure 2:
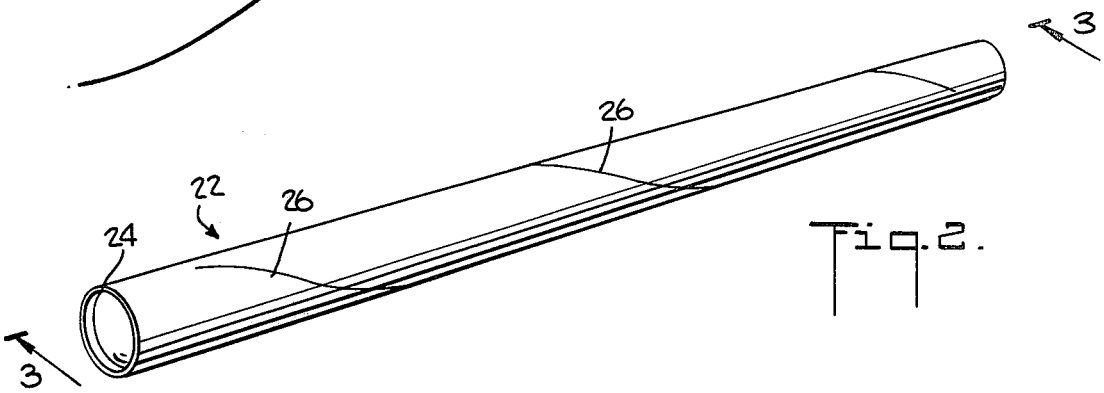
FIG. 2 is a perspective view of the dispensing container of FIG. 1 in its normal closed configuration.
Figure 3:
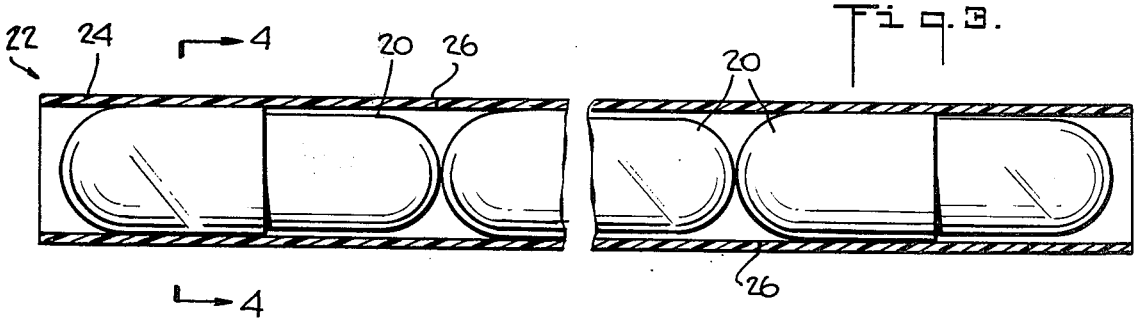
FIG. 3 is a longitudinal section view taken along line 3—3 of FIG. 2.
Figure 4:
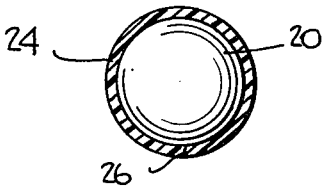
FIG. 4 is a cross section view taken along line 4—4 of FIG. 3.

The dispensing device 22, as shown in FIGS. 2, 3 and 4, comprises an elongated tubular element 24 of plastic or similar material which possesses a sufficient degree of rigidity or stiffness to be self-supporting but which also possesses a sufficient degree of elasticity or resilience to be deformed by twisting as illustrated in FIG. 1. The tubular element may be of low density polyethelene for example. Other material such as polytetrafluralhelyene or nylon may also be used. The wall thickness of the tubular element should be sufficient to sustain the above characteristics. In the present case a wall thickness of 0.015 to 0.030 inches is preferred. The tubular element 24 is slit through along a line 26 which follows a helical path along its length as shown. The helical slit line 26 extends nearly to but does not reach the ends of the element.

Prior to slitting, the inner diameter of the tubular element 24 is slightly larger than that of the pellets 20. It is preferred that the inner diameter of the element 24 be about ten thousandths of an inch (0.010 inch) larger than the diameter of the pellets 20 to be held therein. Once the tubular element is slit, residual stresses cause it to coil inwardly just sufficiently to hold the pellets 20 therein in aligned longitudinal array as shown in FIGS. 3 and 4.

Figure 5:
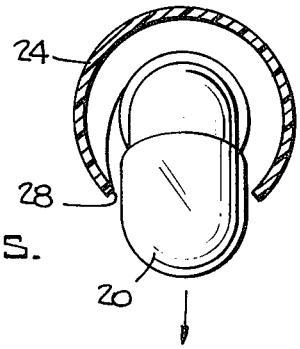
FIG. 5 is a view similar to FIG. 4 but showing the container in a twisted open pellet dispensing condition.

It will be appreciated that the tubular element 24 can be grasped and twisted anywhere along the helical slit line 26 as shown in FIG. 1. When this twist is performed in a helix unwinding direction, the slit opens in the region of the twist and an opening 28 is formed as shown in FIGS. 1 and 5 so that the pellet 20 which happens to be in the vicinity of the twist is released. It will be appreciated that when the tubular element 24 is untwisted to release one of the pellets the element maintains pressure on both sides of the pellet being dispensed, and this serves to pinch off the other pellets from the opening 28 so that one pellet at a time may be dispensed.

After the pellet 20 has been removed, as shown in FIG. 1, the twist is released and the resiliency of the material of the tubular element 24 returns it to its normal closed condition as shown in FIG. 2 while the natural stiffness or rigidity of the element maintains it self supporting in its normal closed condition.

The above described dispensing operation may be carried out without affecting the order or alignment of the other pellets remaining in the device.

FIG. 6 illustrates one form of the container of the present invention. As there shown, tubular element 24 with helical slit 24 is formed with pinched-off and heat-sealed ends 30 which retain the pellets within the container. One end is shown severed.

FIG. 7 illustrates another form of the container of the present invention wherein tubular element 24 is provided with a helical slit 32 which is formed so as to allow overlap of successive turns 34 of the container material. The disposition of pellets 20 within tubular element 24 is shown by hatched lines.

As shown in FIG. 8 the container of the present invention may be used to hold elements of various individual configuration such as ampules 36.

A further modification of the above described container is illustrated in FIG. 9. As there shown, the helical slit line 26 is interrupted over a length A of the tubular element 24; and within this length, the element is formed with circumferential corrugations 38. This allows the tube to bend without stressing the slit regions. By providing several sets of longitudinally disposed corrugations 38 the tubular element may be bent back and forth against itself as shown in FIG. 10. This arrangement may then be held within a compact, rectangularly shaped, outer container 40, as shown in FIG. 11. The device as thus arranged is quite sturdy and self supporting. Moreover it permits selective dispensing of pellets from one region of the device without affecting the pellets in any other region.

Although certain particular embodiments of the invention are herein disclosed for purposes of explanation, various modifications thereof, after study of this specification, will be apparent to those skilled in the art to which the invention pertains.

What is claimed and desired to be secured by Letters Patent is:

1. A pellet container comprising an elongated tubular element having a helical slit extending nearly to each end of the tubular element, the tubular element formed of a strip of stiff but resilient plastic material, containing a plurality of pellet-like elements in aligned array with the inner surface of the container frictionally gripping the elements, the resiliency of the material being sufficient normally to maintain the strip in its closed tubular configuration wherein and adjacent edges of the helical slit are in contact, and to yield to manual twisting forces applied thereto for opening the strip in selected locations for dispensing at least one of its pellet-like elements.

2. A container according to claim 1 wherein the tubular element is formed of a material selected from the group consisting of low density polyethylene, nylon or polytetrafluoroethylene.

3. A container according to claim 2 wherein the tube is formed of low density polyethylene.

4. A container according to claim 3 having a wall thickness of from 0.015 to 0.030 inches.

5. In combination, a pellet container comprising a tubular element of stiff but resilient material, the ends of the element being pinched and heat sealed to form end closures, the element having a slit extending helically thereafalong, the resiliency of the material being sufficient normally to maintain the tubular configuration of the element and to yield to twisting forces applied to the element for opening the slit to dispense the contents of the element, and a plurality of pellets in aligned array and in frictional engagement with the inner surface of the tubular element.

6. In combination, a pellet container comprising a tubular element of stiff but resilient material, the element having a slit extending helically therealong, the resiliency of the material being sufficient normally to maintain the element in its tubular configuration and to yield to twisting forces applied thereto for opening the slit in selected locations thereby to open the tube for dispensing its contents, a plurality of pellets in aligned array contained within the tubular element in frictional engagement with the inner surface thereof, the tubular element having circumferential corrugations at various locations along its length and folded back and forth along its length at the locations and means maintaining the element in its folded condition.

7. A combination according to claim 6 wherein said last mentioned means is a box-like container.

* * * * *